US006233898B1

(12) United States Patent
Burlando

(10) Patent No.: US 6,233,898 B1
(45) Date of Patent: May 22, 2001

(54) REFLECTIVE WARNING AND INFORMATIONAL MOUNTING MEMBER FOR TRAFFIC SIGN POSTS

(76) Inventor: Albert A. Burlando, 2 Joy Dr., Hackettstown, NJ (US) 07840-9600

( * ) Notice: Subject to any disclaimer, the term of this patent is extended or adjusted under 35 U.S.C. 154(b) by 0 days.

(21) Appl. No.: 09/490,157

(22) Filed: Jan. 24, 2000

(51) Int. Cl.[7] ..... E04C 3/30

(52) U.S. Cl. ..... 52/736.3; 52/165; 52/170; 52/736.1; 52/736.4; 116/63 P; 116/63 R; 248/548; 248/900; 40/607; 40/612

(58) Field of Search ..... 52/736.1, 736.3, 52/736.4, 165, 170; 256/DIG. 5; 116/63 R, 63 P, 321, 323; 248/223.41, 548, 900, 345.1; 40/369, 606–608, 582–583, 612; 403/2; 404/9, 10, 13, 14

(56) References Cited

U.S. PATENT DOCUMENTS 3,820,906 * 6/1974 Katt ..... 403/2
4,032,248 * 6/1977 Parduhn et al. ..... 404/10
5,125,194 * 6/1992 Granger ..... 52/98
5,214,886 * 6/1993 Hugron ..... 52/98
5,480,121 * 1/1996 Rice et al. ..... 248/548
5,560,131 * 10/1996 Gibson ..... 40/607
5,794,910 * 8/1998 Granger ..... 248/548
5,848,502 * 12/1998 Schaefer ..... 52/165
5,887,842 * 3/1999 Granger ..... 248/548
5,957,425 * 9/1999 Conway et al. ..... 248/548
6,113,307 * 9/2000 Joyner, III et al. ..... 404/10
6,158,379 * 12/2000 Burlando ..... 116/63 R

* cited by examiner

*Primary Examiner*—Carl D. Friedman
*Assistant Examiner*—Yvonne M. Horton
(74) *Attorney, Agent, or Firm*—Clifford G. Frayne

(57) ABSTRACT

A reflective mounting member mountable to a traffic sign post to augment the warning capability of the sign post or to provide a text message, the sign post being defined by a rear wall, divergent side walls extending from said rear wall and terminating in opposing planar flanges thereby defining a U-shaped longitudinal channel, the mounting member having a U-shaped channel formed therein such that it mates about the exterior of the U-shaped channel of the traffic sign post and is mounted thereto.

15 Claims, 3 Drawing Sheets

REFLECTIVE WARNING AND INFORMATIONAL MOUNTING MEMBER FOR TRAFFIC SIGN POSTS

BACKGROUND OF THE INVENTION

1. Field of the Invention

The present invention relates to the field of traffic sign posts and in particular to a mounting member which mates with the exterior U-shaped section of the existing sign post and has a reflective and/or fluorescent member so as to provide the additional safety reflection and also information.

2. Description of the Prior Art

Traffic sign posts are encountered every day by motorists regardless of the length of their journey. The sign posts are positioned on the sides of the highway or road and at intersections and support signs which advise motorists of the actions they should take, e.g. STOP, YIELD, ONE WAY, TURN, etc., and as delineators to identify the road shoulders. The traffic signs mounted on the traffic sign posts are also color coded and reflective. Stop signs are red, informational signs are black and white, and warning signs are yellow.

The traffic sign posts themselves have been standardized over the years and are generally U-shaped in cross section having opposing outstanding flanges. A plurality of apertures are positioned in the rear face of the traffic sign post and the traffic signs themselves are mounted by means of a threaded fastener passing through the sign which is juxtaposed against the flanges, the fastener extending through apertures in the rear face and secured. The traffic sign posts are generally standardized to the U-shaped section in cross section, but may vary in the cross section dimensions, e.g. the width and depth of the U-shaped channel, depending upon the size or load of the sign that is positioned thereon.

These standardized traffic sign posts can be found on every street and road in a community and in most instances their sole purpose is to support the traffic sign itself. One problem encountered with traffic signs is that as a result of their exposure to sunlight and in particular, the UV light from the sun, the color and reflectivity of the signs decreases over time such that the warranty offered by companies which manufacture the signs is limited often to less than seven years. One object of the present invention is to provide an additional reflective capability to the traffic sign post which can extend the useful life of the traffic sign as a warning device.

Additionally the existing traffic sign post is one dimensional in that it serves one mission, that of supporting the traffic sign when in fact because of their placement and frequency, they could impart additional information. In the Applicant's invention, a mounting member is utilized, the cross section of which is such that it would mate about the exterior of the U-shaped cross section of the traffic sign post and present a vertical support of varying widths and lengths on the sign post for receipt of the reflective and/or fluorescent member so as to provide additional warning reflectivity and which could also have messages positioned thereon of a safety, directional, or commercial nature.

The reflective character of the traffic sign would be enhanced by the fact that a reflector and/or fluorescent member which would be color coded to the type of sign, would be vertically aligned and secured to the traffic sign post so as to better gain the visual attention of the motorist.

OBJECTS OF THE INVENTION

An object of the present invention is to provide for a novel reflective and/or fluorescent member securable to existing traffic sign posts which reflective member enhances the warning capability intended to be given to the motorist by the traffic sign.

A further object of the present invention is to provide for a novel reflective and/or fluorescent member and mounting member which mounting member has a cross section such that it can mate about the exterior of the U-shaped traffic sign post and present a vertical face for receipt of a member having a reflective capability and/or an informational capability.

A still further object of the present invention is to provide for a novel reflective member and mounting member which can be easily mated to existing traffic sign posts without any modifications to the existing traffic sign post.

SUMMARY OF THE INVENTION

A reflective and/or fluorescent member mountable to a traffic sign post to augment the warning capability of the traffic sign mounted on the traffic sign post, the reflective and/or fluorescent: member is mounted on the face of a mounting member, the mounting member having a cross section such that it mates about the exterior of the U-shaped channel of the traffic sign post, the reflective and/or fluorescent member may also include information of a safety, directional or commercial nature.

BRIEF DESCRIPTION OF THE DRAWINGS

These and other objects of the present invention will become evident, particularly when taken in light of the following illustrations wherein.

DETAILED DESCRIPTION OF THE DRAWINGS

Figure 1:
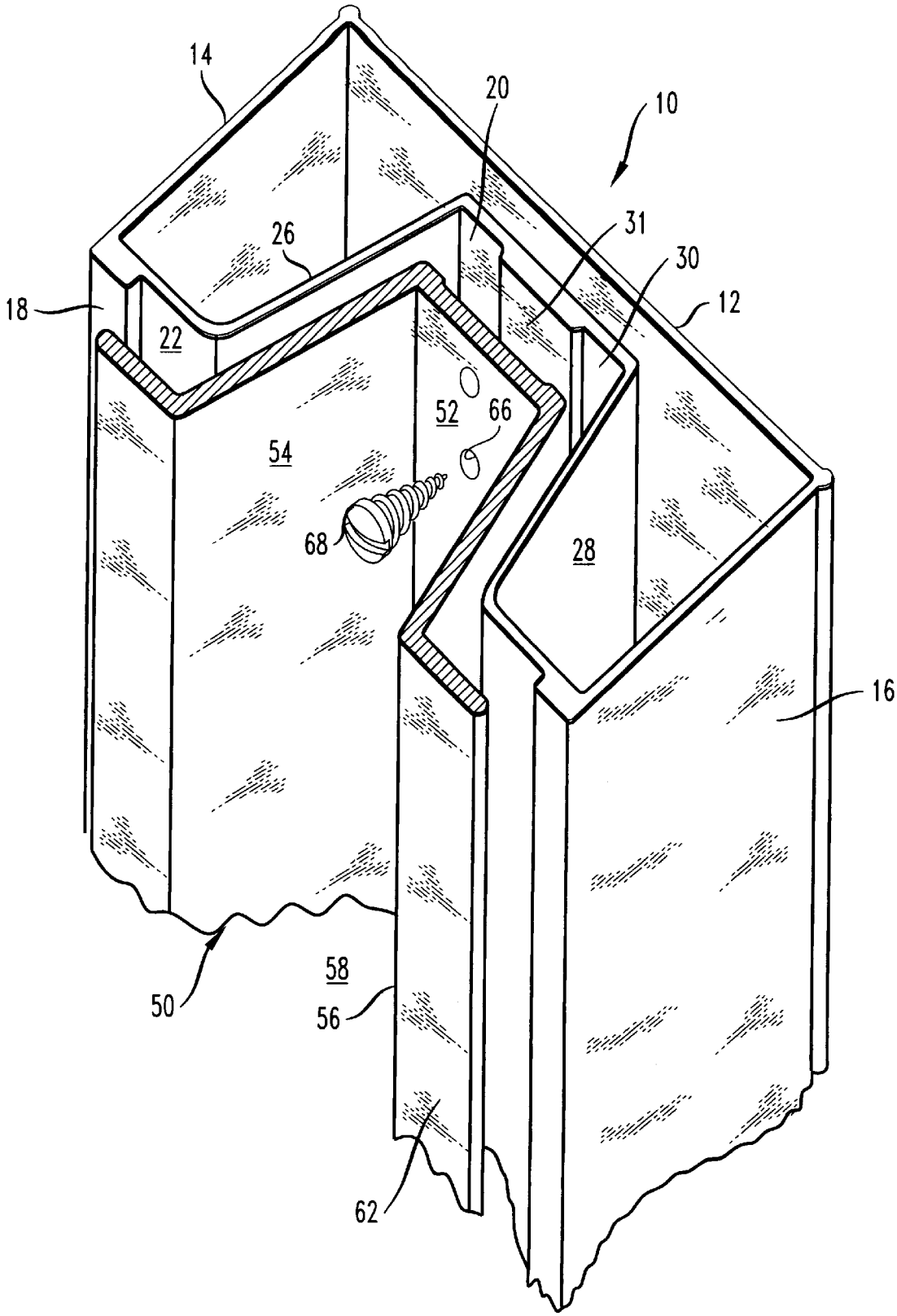
FIG. 1 is an exploded perspective view of the sign post and mounting member of the present invention.
Figure 2:
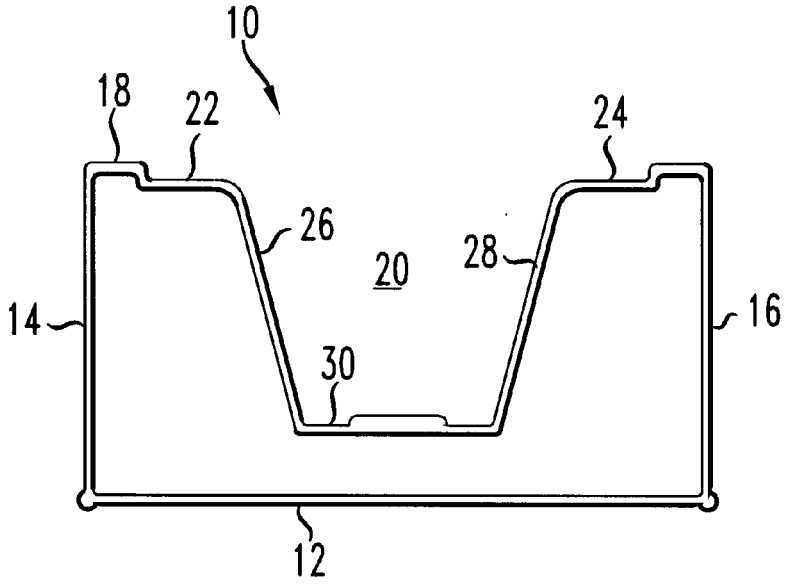
FIG. 2 is a cross section of the reflective member and mounting member of the present invention.

Referring now to the drawings and particularly FIGS. 1 and 2, there is illustrated an exploded perspective view of a mounting member of the present invention generally indicated as 10 and a standardized traffic sign post 50 commonly referred to in the trade as a U-channel post and a cross sectional view of mounting member 10. The mounting member 10 is an elongate tubular member having a front face 12, side faces 14 and 16, and a rear face 18 having a stepped surface and a longitudinal depressional channel 20 formed therein which is trapezoidal in cross section. Rear face 18 is stepped inwardly towards front face 12 forming planar walls 22 and 24 recessed from rear face 18. Planar walls 22 and 24 communicate with converging side walls 26 and 28 of longitudinal depressional channel 20, and converging side walls 26 and 28 terminate in a rear wall 30 of depressional longitudinal channel 20, which is parallel and spaced apart from front face 12. Mounting member 10 can made of any suitable material, but it has been found that the extrusion of rigid thermoplastic is best suited for forming tubular mounting member 10.

Traffic sign post 50 is of a standardized design and is defined by a front face 52, diverging side walls 54 and 56 which terminate with opposing flanges 60 and 62 which are in the same plane and define the rear face of the traffic sign post 50. This configuration defines a trapezoidal space 58. The front face 52 of traffic sign post 50 has formed therein a plurality of vertically aligned, spaced apart apertures 66 extending the length of front face 52. In normal practice, a traffic sign (not shown) would be juxtaposed against flanges 60 and 62 and a suitable fastening means would extend through apertures in the traffic sign and pass through the apertures 66 in front face 52 in order to secure the traffic sign to the traffic sign post 50. The mounting member of the present invention utilizes several of the apertures 66 in front face 52 in order to secure mounting member 10 to traffic sign post 50.

Rear wall 30 of depressional longitudinal channel 20 is formed with a longitudinally disposed portion 31 which is of a greater thickness than adjacent portions of rear wall 30 of depressional longitudinal channel 20 so as to provide for a thicker surface for the threaded fastener 68 utilized to secure mounting member 10 to traffic sign post 50. The number of fasteners utilized would be determined by the height of traffic sign post 50 and the height of the mounting member 10 to be secured thereto. The cross sectional trapezoidal configuration of depressional longitudinal channel 20 permits mounting member 10 to mate with the trapezoidal cross sectional configuration of traffic sign post 10 in close fitting relationship as illustrated in FIG. 1.

Figure 3:
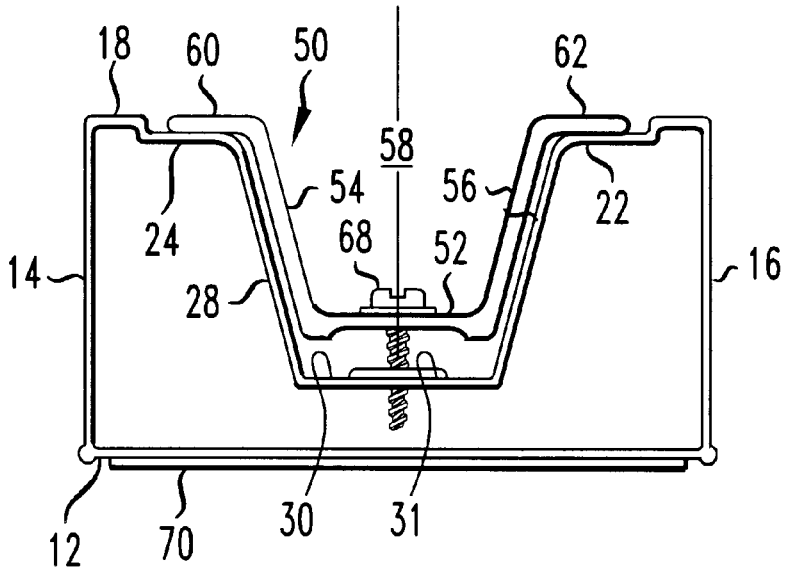
FIG. 3 is a top view of the mounting member and reflective member positioned on a traffic sign post.

FIG. 3 is a top cross sectional view of mounting member 10 secured to traffic sign post 50A which has cross section dimensions greater than traffic sign post 50. Mounting member 10 mates with traffic sign post 50A in the same manner and performs the same function, however, the close fitting relationship is less than that illustrated in FIG. 1. The dimension cross section of mounting member 10 allows mounting member 10 to be utilized with traffic sign posts having trapezoidal U-sections of varying width and depth. Fastener 68 has been positioned through an, aperture 66 in front face 52 of traffic sign post 50 such that it penetrates rear wall 30 of depressional longitudinal channel 20 at portion 31. A suitable fastener means would be dimensioned to penetrate the rear wall 30 and enter the space of tubular mounting member 10, the interior space of tubular mounting member 10 but would not penetrate the front wall 12.

FIG. 3 also illustrates the utilization of front wall 12 for a reflective member 70 or alternatively a textual message. Reflective member 70 comprises a reflective strip secured to front face 12 by a suitable adhesive means. Alternatively, if it was desired to provide a textual message of a safety or directional nature such as "buckle up" or "no right turn" then such a textual message could be prepared in strip form and adhered to front face 12.

FIG. 3 further illustrates that the stepped rear face of mounting member 10, particularly the step between rear face 18 and intermediate planar walls 22 and 24 is dimensioned to the approximate thickness of the flanges 60 and 62 of traffic sign post 10. This permits a further embodiment mounting member 10 as illustrated in FIG. 4.

Figure 4:
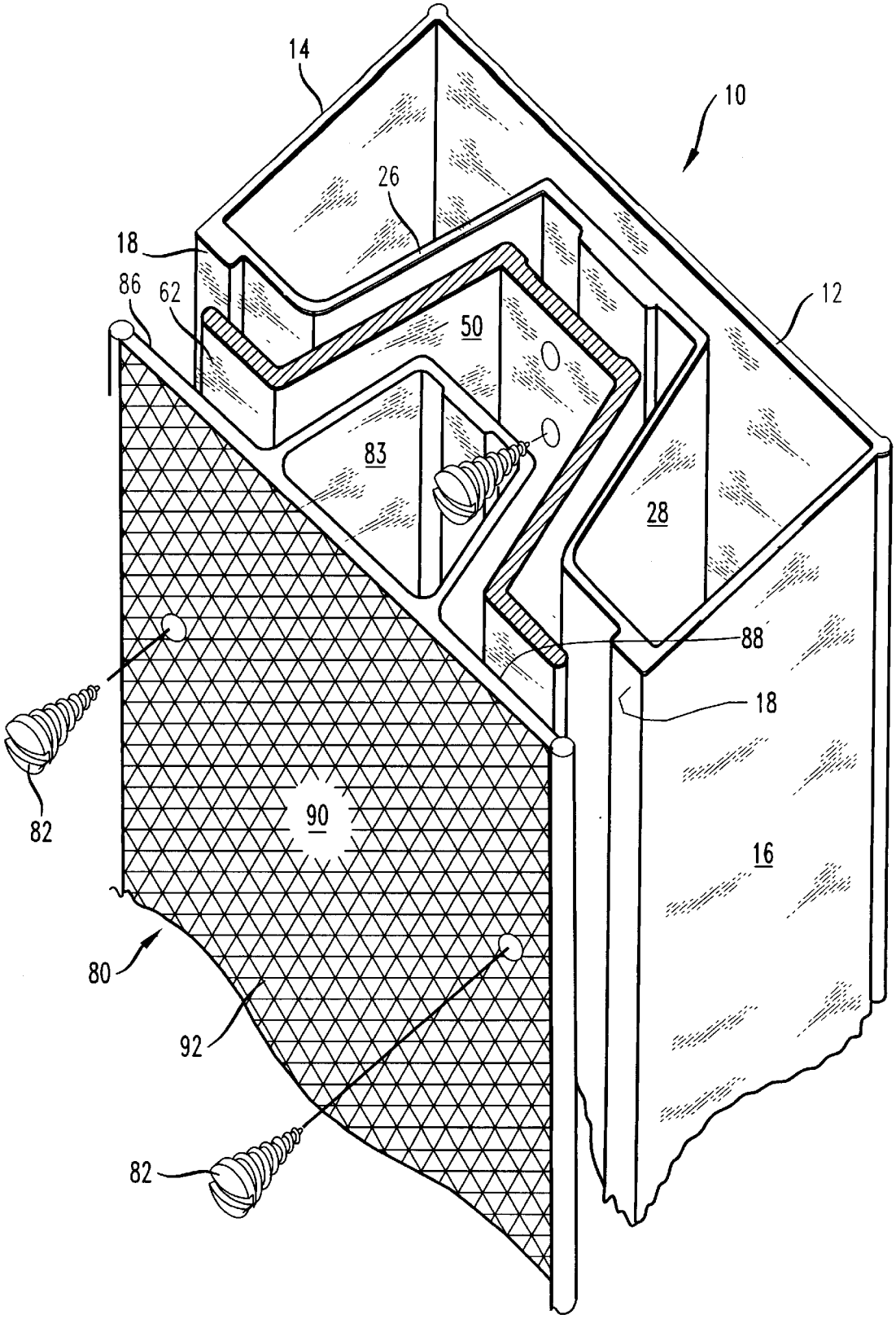
FIG. 4 is a top view of the mounting member and reflective member mounted to the exterior of the sign post with an additional mounting member and reflective member mounted to the face of the sign post.

FIG. 4 illustrates the mounting member 10 of the present invention secured to traffic sign post 50 in the manner previously described. In many instances it may be desirable to fully encapsulate the traffic sign post such that a reflective warning or textual message may be provided on two sides or all sides of the sign post. In such an instance, a second mounting member 80 would be secured to mounting member 10 by means of threaded fasteners 82 passing through the longitudinal edges of second mounting member 80 and through the rear face portion 18 of first mounting member 10. In the extrusion process of mounting member 10, rear face portions 18 were fabricated of a greater thickness than adjacent walls in order to accommodate this embodiment. With flanges 60 and 62 recessed from the rear face portion 18 and juxtaposed against planar walls 22 and 24, second mounting member 80 can be mounted flush to the traffic sign post flanges 60 and 62.

Second mounting member 80 as illustrated in FIG. 4 is an extruded tubular member having a trapezoidal cross section 83 which mates with the interior trapezoidal cross section of the traffic sign post 50. Lateral flanges 86 and 88 which extend outwardly from the extruded tubular member and are dimensioned to coincide with the rear face 18 of first mounting member 10. The outer face 90 of second mounting member 80 would have affixed thereto a reflective material 92 or textual message, similar to the manner in which the same are mounted on first mounting member 10. In this configuration, the traffic sign post 50 is encapsulated by first mounting member 10 and second mounting member 80. Additionally, for further safety additional reflective material or textual messages could be positioned on side walls 14 and 16 of first mounting member 10.

While the present invention has been described with respect to the exemplary embodiments thereof, it will be recognized by those of ordinary skill in the art that many modifications and alterations may be made without departing from the spirit and scope of the invention. Therefore it is manifestly intended that the invention be limited only by the scope of the claims and the equivalence thereof.

I claim:

1. A combination assembly including traffic sign post and mounting member to increase the traffic sign post's warning capability and to impart a textual message, said combination comprising:

a traffic sign post having a rear wall, said rear wall having a plurality of vertically spaced apart apertures positioned therein, two divergent side walls extending from said rear wall and defining a vertical U-shaped channel, said two divergent side walls terminating with opposed outwardly extended flanges parallel with said rear wall, said rear wall, divergent side walls and said flanges thereby defining a front face with said vertical U-shaped channel and an opposing rear face;

an elongate tubular member having a front wall, two parallel perpendicular side walls extending rearwardly from said front wall, and a rear wall defined by two longitudinal edges perpendicular to said side walls and parallel to said front wall, said longitudinal edges being stepped inwardly to form two parallel planar surfaces, said parallel planar surfaces terminating with recessed converging side walls terminating in a recessed interior rear wall parallel to said front wall and spaced apart therefrom, said recessed interior rear wall and said converging side walls thereby defining a vertical U-shaped channel longitudinally disposed in said mounting member, said vertical U-shaped channel complimentary with and juxtaposed over said rear face of said traffic sign post;

a securing means positioned through said apertures of said rear wall of said traffic sign post and into said recessed interior rear wall of said U-shaped channel of said mounting member.

2. The combination mounting assembly and traffic sign post in accordance with claim 1 wherein said front wall of said mounting member is adapted to receive a reflective member.

3. The combination mounting assembly and traffic sign post in accordance with claim 1 wherein said side walls of said mounting member are adapted to receive a reflective member.

4. The combination mounting assembly and traffic sign post in accordance with claim 1 wherein said front wall of said mounting member is adapted to receive a text message.

5. The combination mounting assembly and traffic sign post in accordance with claim 1 wherein said side walls of said mounting member are adapted to receive a text message.

6. The combination mounting assembly and traffic sign post in accordance with claim 1 wherein said vertical U-shaped channel of said mounting member is recessed and said longitudinal edges of said rear wall of said mounting member is in planar relationship with said front face of said traffic sign post defined by said outwardly extending flanges of said traffic sign post.

7. The combination mounting assembly and traffic sign post in accordance with claim 1 wherein said mounting member is formed with said longitudinal edges of said rear wall of a thickness greater than said front wall and said side walls.

8. The combination mounting assembly and traffic sign post in accordance with claim 1 wherein said recessed interior rear wall of said vertical U-shaped channel is formed of a thickness greater than said converging side walls.

9. The combination mounting assembly and traffic sign post in accordance with claim 1 which further includes a second mounting member of tubular construction cooperative with said front face of said traffic sign post and secured to said mounting member juxtaposed and secured to said rear face of said traffic sign post.

10. The combination mounting assembly and traffic sign post in accordance with claim 9 wherein said second mounting member is of tubular construction having a trapezoidal tubular member cooperative with said U-shaped channel of said traffic sign post, said trapezoidal tubular member having flanges extending outwardly therefrom and cooperative with said longitudinal edges of said rear face of said mounting member juxtaposed over said rear face of said traffic sign post for securing said second mounting member to said mounting member juxtaposed over said rear face of said traffic sign post, said second mounting member having a planar outer surface.

11. The combination mounting assembly and traffic sign post in accordance with claim 10 wherein said planar outer surface of said second mounting member is adapted to receive a reflective member.

12. The combination mounting assembly and traffic sign post in accordance with claim 10 wherein said planar outer surface of said second mounting member is adapted to receive a text message.

13. A mounting member for attachment to a traffic sign post to increase the traffic sign post warning capability and to impart a textual message, said mounting member comprising:

an elongate tubular member having a front wall, two parallel perpendicular side walls extending rearwardly from said front wall, and a rear wall defined by two longitudinal edges perpendicular to said side walls and parallel to said front wall, said longitudinal edges being stepped inwardly to form two parallel planar surfaces, said parallel planar surfaces terminating with recessed converging side walls terminating in a recessed interior rear wall parallel to said front wall and spaced apart therefrom, said recessed rear interior wall and said converging side walls thereby defining a vertical U-shaped channel longitudinally disposed in said mounting member.

14. The mounting member in accordance with claim 13 wherein said recessed interior rear wall of said vertical U-shaped channel is formed of a thickness greater than said adjacent converging side walls respectively for receipt of a threaded fastener means.

15. The mounting member in accordance with claim 13 wherein said mounting member is of one piece extruded tubular construction.

* * * * *